United States Patent [19]

Driessen

[11] Patent Number: 4,549,244

[45] Date of Patent: Oct. 22, 1985

[54] CORONA GENERATING DEVICE

[75] Inventor: Wilhelmus G. M. Driessen, Fairport, N.Y.

[73] Assignee: Xerox Corporation, Stamford, Conn.

[21] Appl. No.: 559,586

[22] Filed: Dec. 8, 1983

[51] Int. Cl.[4] ..... H01T 19/00

[52] U.S. Cl. ..... 361/229; 361/230

[58] Field of Search ..... 361/213, 229, 235, 225, 361/230; 250/324, 326; 355/3 CH, 14 CH

[56] References Cited

U.S. PATENT DOCUMENTS

| | | | |
|---|---|---|---|
| 3,476,935 | 11/1969 | Metcalf et al. | 250/49.5 |
| 3,566,223 | 2/1971 | Salger | 317/262 |
| 3,578,970 | 5/1971 | Michaud | 250/49.5 ZC |
| 3,656,021 | 4/1972 | Furuichi et al. | 317/4 |
| 3,883,240 | 5/1975 | Ito et al. | 355/3 DD |
| 3,943,418 | 3/1976 | Ouang | 317/262 A |
| 4,027,201 | 5/1977 | Bacon et al. | 361/213 |
| 4,104,521 | 8/1978 | Herrmann, Jr. et al. | 250/324 |
| 4,110,811 | 8/1978 | Hubble, III et al. | 361/255 |
| 4,163,273 | 7/1979 | Stocke | 361/229 |
| 4,233,511 | 11/1980 | Harada et al. | 250/324 |
| 4,322,156 | 3/1982 | Kehyama | 355/3 CH |
| 4,408,865 | 10/1983 | Camis et al. | 355/3 CH |

*Primary Examiner*—Reinhard J. Eisenzopf

*Assistant Examiner*—Hong K. Choe

[57] ABSTRACT

A corona generating device for producing uniform charge along the length of the generating device is described which comprises a plurality of separate parallel coronode wires supported between insulating end block assemblies with the coronode wires being closely spaced relative to the adjacent wire such that when energized, each wire is placed within the electrostatic fringe field of the adjacent wire. In a preferred embodiment the device comprises a pair of parallel coronode wires formed from a single U-shaped wire with a closed end portion wrapped around an arcuate insulating end post in a first end block assembly, and an arcuate insulating end post in the second end block assembly around which the ends of the coronode wire may be wrapped, and insulating block adapters at both ends of the device having wire positioning slits therein, the end post being larger in diameter than the width of said slits in said end block adapters whereby the pair of wires is urged against opposite sides of the slit. Preferably the corona generating device includes a conductive shield extending between the supporting end block assemblies and the coronode wire is tungsten oxide with the two wires being spaced less than 0.2 inches apart.

8 Claims, 7 Drawing Figures

INVENTION

CORONA GENERATING DEVICE

BACKGROUND OF THE INVENTION

This invention relates to electrostatographic reproducing apparatus and more particularly to a novel corona generating device, together with method for using such a device to improve copy quality.

In an electrostatographic reproducing apparatus commonly used today, a photoconductive insulating member is typically charged to a positive potential, thereafter exposed to a light image of an original document to be reproduced. The exposure discharges the photoconductive insulating surface in exposed of background areas and creates an electrostatic latent image on the member which corresponds to the image areas contained within the original document. Subsequently, the electrostatic latent image on the photoconductive insulating surface is made visible by developing the image with a developing powder referred to in the art as toner. During development the toner particles are attracted from the carrier particles by the charge pattern of the image areas on the photoconductive insulating area to form a powder image on the photoconductive area. This image may be subsequently transferred to a support surface such as copy paper to which it may be permanently affixed by heating or by the application of pressure. Following transfer of the toner image to the support surface the photoconductive insulating surface may be discharged and cleaned of residual toner to prepare for the next imaging cycle.

In the commercially available electrostatographic reproducing apparatus, attempts are constantly being made to improve the output and in particular, the copy quality of the product produced from such an apparatus. One of the difficulties frequently encountered is the occurrence of streaking in the final copy. By streaking it is intended to define that abnormally high or abnormally low level of toner deposition on the photoconductive surface during the imaging cycle and the subsequent transfer of the toner to the copy sheet. This may occur, for example, as the photoconductive surface, typically in the form of a rotating cylindrical drum, rotates from image cycle to image cycle building up non-uniform charge and therefore non-uniform toner which results in such streaks. For example, in a typical commercial embodiment a photoconductive layer made of a selenium alloy is positively charged and developed with negatively charged toner. Following transfer of toner image in configuration to the copy sheet, it may be discharged by a corona from an AC corotron prior to cleaning for the next imaging cycle. This pre-clean corotron is typically used to remove residual charge on the drum to a zero level to prepare it for the next imaging cycle. Without doing this one would obtain a streaking problem in the copier due to the cyclic history of non-uniform build up. This is particularly magnified if the drum has been used to make 100 copies of an original with the same areas being repeatedly charged and developed, and other areas being greatly fatigued due to exposure in a non-uniform fashion.

An AC corotron generates corona of both a positive and negative phase which tends to be non-uniform along the length of the wire as to current output in the negative phase. Thus, on being discharged, the drum sees the sum of the two phases which is a non-uniform current output or distribution. This locally causes non-uniform discharging on the drum and in subsequent image cycles portions of the drum receive a non-uniform build up of negative charge. Furthermore, once the negative charge has been injected into the selenium alloy drum, they have a tendency to become locallized or bound in the photoconductive layer and tend to dissipate very slowly, thus resulting in a cyclic build up of negative charge in the photoconductive layer. While not wishing to be bound to any theory, it is believed that the negative charge is trapped in the photoconductive layer. Thus on a subsequent cycle, where the photoconductive layer is positvely charged, the negative charged portions of the photoconductor are cyclically built up requiring increasing amounts of positive charge to neutralize them in subsequent imaging cycles. This is in contrast to a positive charge on the selenium alloy which as a charge carrier has such mobility that it goes directly to the conductive substrate on the photoreceptor. By contrast, it is believed that the negative carrier travels 30 to 40 times as slow as the positive charge. Furthermore, and to compound the difficulties, it is believed that any negative charge present on the photoreceptor in subsequent imaging cycles appears to be capable of holding more than its equivalent in positive charge which provides an additional internal positive charge build up in the photoconductor. Finally, the difficulty is compounded if the photoconductor drum is used to repetitively make a large number of copies of the same original in that certain areas are greatly fatigued which causes the drum to charge subsequently in subsequent imaging cycles in a non-uniform fashion which results in more toner being deposited in higher charged areas and eventually streaking in the final copy output.

Many of the above difficulties are traced to the non-uniformity of corona generation along the length of the corotron wire which is positioned in the reproducing apparatus typically so that the photoconductive surface passes parallel to and adjacent to it. Reference to FIG. 1 illustrates the positive and negative phase as well as the difference in charge that may be obtained from a standard AC corona generating device. In the bottom portion of FIG. 1, the positive charge along the length, for example, of an AC corotron is shown as being relatively even and constant. In contrast, the negative phase represented in the top of the graph is shown as being relatively uneven having locallized peaks and valleys. The dashed line in the top of the Figure is a transposition of the positive phase to the negative phase with the hatched area representing the residual negative charge to the photoconductor in the imaging cycle. This difference between the positive and negative charge uniformity in an AC corona generating device is believed to be dependent upon the defects and deficiencies in the wire. It is known that the corona generated along the corona wire varies drastically depending upon the thickness of the wire. A thin wire has a much lower threshold potential and therefore produces a higher corona than a thick wire. It takes longer and more charge for a thicker wire to create the same corona.

Thus the streaking problem is broken into two essential aspects. One the build up even for uniform document input based on non-uniform charging and secondly the effect of repetitive copying of the same original so that the same portions of the photoconductor drum are imaged and discharged on repeated cycles providing a build up of charge in the same areas thereby requiring more toner to develop it which is subsequently transferred to the copy sheet. The gradual build up of trapped charge may even reach a level where it completely changes the cycling imaging characteristics of the drum.

One way of providing a more uniformly controlled charge is with the use of a screen controlled device called a scorotron which consists of one or more fine wires supported on insulated blocks spaced between the photoconductive surface and a grounded conductive surface parallel to it. A screen or grid is interposed between the corona wires and the photoconductive plate and the grid is maintained at a potential roughly equal to the potential desired on the plate. Typically in the scorotrons geometry, the individual wires are from ½ to 1½ inches apart and are spaced from the grid by about ¾ of an inch. In theory ions from the corona wires will pass between the grid wires and continue on to the plate as long as the potential difference is large between the grid and the plate. When the plate has reached sufficient charge that it is potentially matched to that of the grid charging will cease. While these devices provide good control and excellent reproducibility of potential, they are complex in construction, costly to manufacture, difficult to keep clean and repair, and require power sources for both corona wires and the screen and, are typically bulky occuping considerable space in the machine.

PRIOR ART

U.S. Pat. No. 3,656,021 (Furuichi, et al.) describes a corona discharge device in which a vibration suppression member is provided between the wire electrodes and counter electrodes or plates to prevent transverse vibration of the electrode by electrostatic force. The wire electrode is spaced 7.5 mm from counter electrodes thereby providing distance between wires of about 15 mm or about 0.6 inches.

U.S. Pat. No. 3,943,418 (Quang) describes a corona charging device having a U-shaped corona wire mounted in an insulating end block having a spring biased plunger to hold the wire in tension while permitting easier replacment of the wire.

SUMMARY OF THE INVENTION

In accordance with the present invention, a corona generating device providing more uniform charging as well as a method of more uniformly charging a layer is provided. In accordance with a principle aspect of the present invention, the corona generating device comprises a plurality of separate parallel coronode wires supported between insulating end block assemblies with the plurality of coronode wires being closely spaced relative to the adjacent wire such that when the wires are energized each wire is placed within the electrostatic fringe field of the adjacent wires. Because the adjacent wires are within the fringe field of each other, one has a tendency to suppress the high output of the other and thereby provide more uniform charge along the length of the corona generating device.

In a specific aspect of the present invention, the corona generating device comprises a pair of parallel coronode wires which are formed from a single U-shaped wire with a closed end portion wrapped around an arcuate insulating end post in a first end block assembly.

In a further aspect of the present invention, an arcuate insulating end post is provided at the second end block assembly together with insulating end block adapters at both ends of the device having wire positioning slits therein with the end posts being larger in diameter than the width of the slits in the end block adapters whereby said pair of wires by being wrapped around said end posts are urged against opposite sides of the slit in the end block assemblies.

In an additional aspect of the present invention, the corona generating device includes a conductive shield extending between and fixedly supporting end block assemblies.

In a further aspect of the present invention, the coronode wires are made out of tungsten oxide and are spaced less than 0.2 inches apart.

In an additional aspect of the present invention, a method of charging a layer with greatly improved charge uniformity is provided.

In an additional aspect of the present invention, methods and apparatus for improving copy quality in electrostatographic reproducing machines is provided.

For a better understanding of the invention as well as other aspects and further features thereof, reference is had to the following drawings and description.

DESCRIPTION OF THE PREFERRED EMBODIMENT

The invention will now be described with reference to a preferred embodiment.

Figure 3:
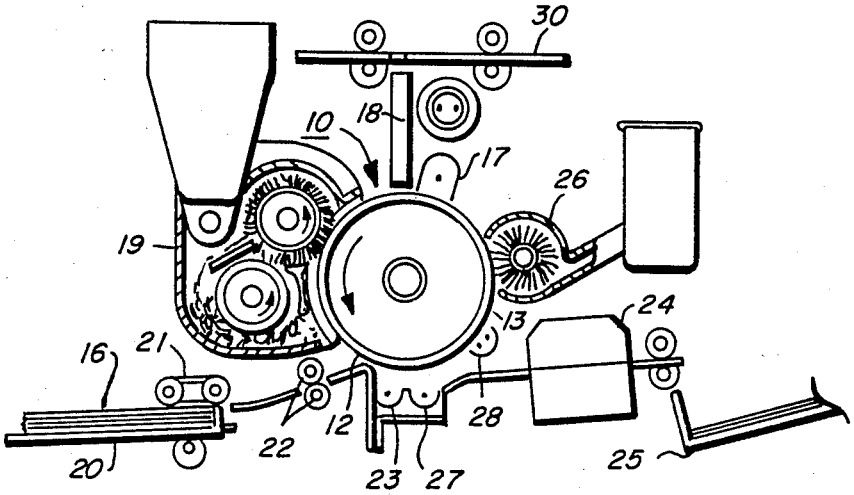
FIG. 3 is a schematic representation in cross section of an automatic electrostaticgraphic reproducing machine with a corona generating device according to the present invention used as a pre-clean corotron.

Referring now to FIG. 3 there is shown by way of example an automatic xerographic reproducing machine 10 which includes the corona generating device of the present invention. The reproducing machine 10 depicted in FIG. 3 illustrates the various components utilized therein for producing copies from an original document. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in the application to the particular embodiments shown herein.

The reproducing machine 10, illustrated in FIG. 3 employs an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

Initially, the drum 12 moves the photoconductive surface 13 through a charging station 17 where an electrostatic charge is placed uniformly over the photoconductive surface 13 in known manner preparatory to imaging. Thereafter, the drum 12 rotates to exposure station 18 where the charged photoconductive surface 13 is exposed to a light image of the original input scene information whereby the charge is selectively dissipated in the light exposed regions to record the original input scene in the form of an electrostatic latent image. After exposure drum 12 rotates the electrostatic latent image recorded on the photoconductive surface 13 to development station 19 wherein a conventional developer mix is applied to the photoconductive surface of the drum 12 rendering the latent image visible. Typically a suitable development station could include a magnetic brush development system utilizing a magnetizable developer mix having coarse ferromagnetic carrier granules and toner colorant particles.

Sheets 16 of the final support material are supported in a stack arrangement on an elevating stack support tray 20. With the stack at its elevated position a sheet separator feed belt 21 feeds individual sheets therefrom to the registration pinch rolls 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16. Following transfer of the image the final support material which may be paper, plastic, etc., as desired is transported through detack station where detack corotron 27 uniformly charges the support material to separate it from the drum 12.

After the toner image has been transferred to the sheet of final support material 16 the sheet with the image thereon is advanced to a suitable fuser 24 which coalesces the transferred powder image thereto. After the fusing process the sheet 16 is advanced to a suitable output device such as tray 25.

Although a preponderance of toner powder is transferred to the final support material 16, invariably some residual toner remains on the photoconductive surface 13 after the transfer of the toner powder image to the final support material. Following transfer of the toner image to the final support material, the residual charge remaining on the drum is reduced by the corona generated from the two wire pre-clean AC corotron 28 according to the present invention.

It is believed that the foregoing general description is sufficient for the purposes of the present application to illustrate the general operation of an automatic xerographic copier which can embody the apparatus according to the present invention.

Figure 4:
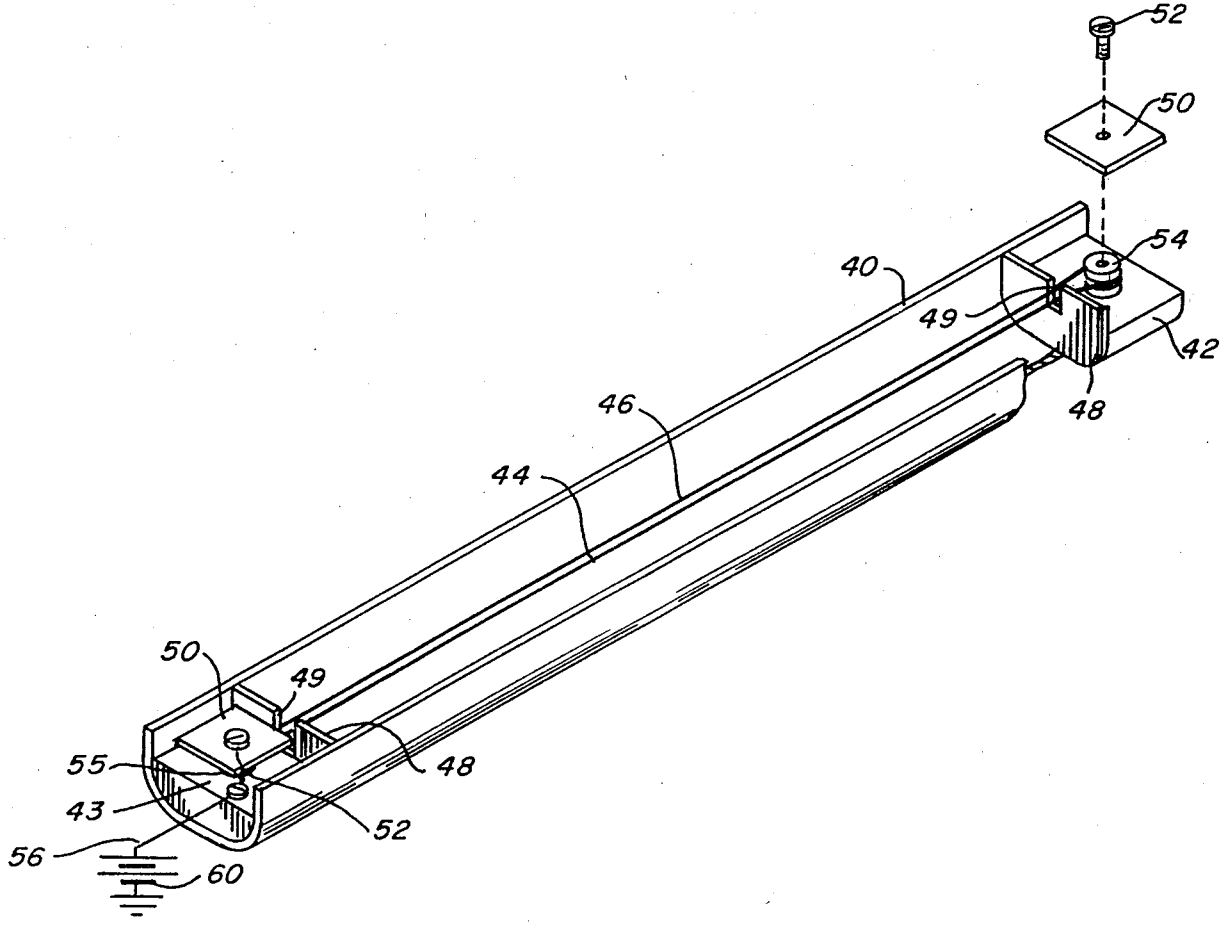
FIG. 4 is an isometric view of a two wire corona generating device according to the present invention.
Figure 5:
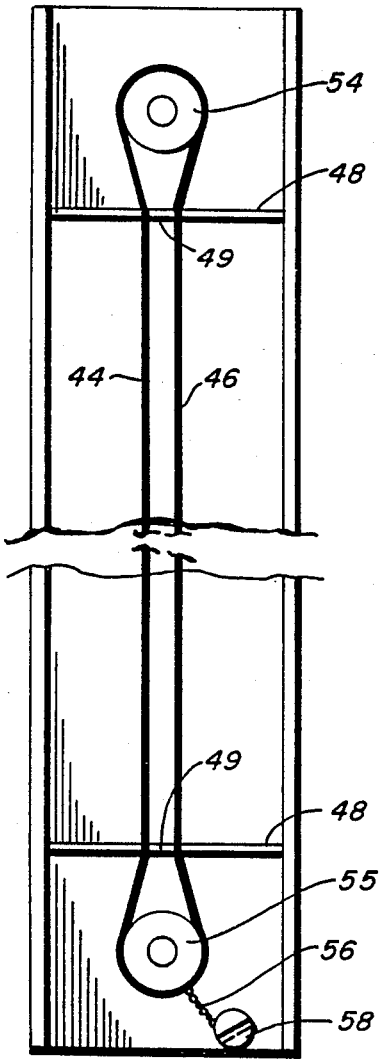
FIG. 5 is a plan view of the corona generating device according to the present invention.

Referring more specifically to FIGS. 4 and 5 wherein a preferred embodiment of the corona generating device according to the present invention as illustrated, two corona wires 44 and 46 are supported between insulating end block assemblies 42 and 43. A conductive corotron shield 40 provides a means for localizing or confining the current and also provides structural support. The two corona wires in this embodiment are provided by a single strand of wire which at its center is looped around retaining post 54 in end block 42 at one end of the corona generating device with the two ends of the wire being looped around opposing retaining post 55 at the opposite end of the device where the ends are twisted with the twisted double ends being brought into contact 56 with the contact from corona potential generating source 60. Screw plates or clamps 50 holds the wires 44 and 46 in place through means of tightening screws at each end block assembly 52. Each of the end block assemblies has an end block adapter 48 which comprises a thin insulating layer of material with a slit 49 in it, the slit being positioned so that the wires are in contact with the inside of the slit members. This happens because the post around which the wire is wrapped at the one end and the wire retaining post at the other end are both of a larger diameter than the slit thereby urging both sides of the wire into contact with the opposing sides of the insulating end block adapter. FIG. 5, in particular, illustrates the manner in which the two wires are maintained separate from each other but parallel and are urged into contact with the insulating end block adapters.

The two wires are spaced within the corona charging device so that the electrostatic fringe fields of one will interfer with the electrostatic fringe field generated by the other to a substantial degree thereby providing more uniform corona. This is based in part on the proposition that if one wire has weak points the probability that two wires will have the same weak point in areas opposite each other is rather remote. The spacing of the two wires is absolutely critical, they must be within the fringe fields generated by each other. It is also belived that since the two parallel wires provide intersecting fringe fields, a point on one wire opposite a point on the other wire has a tendency to supress the high output of the other wire. Furthermore, the wires should be parallel to each other to optimize this supressing effect by each wire on the other wire.

Figure 1:
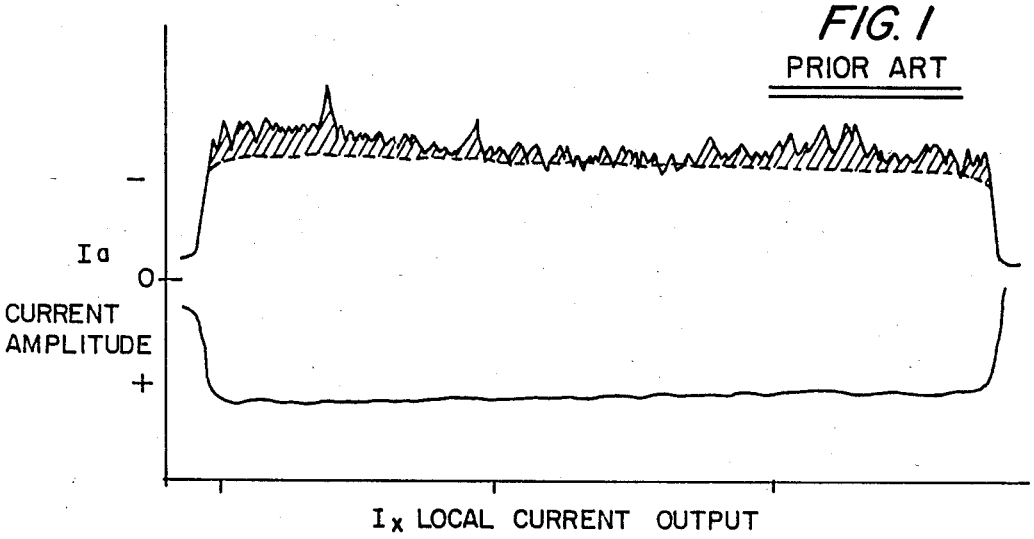
FIG. 1 PRIOR ART
FIG. 1 illustrates the positive and negative current profile along the length of the wire together with the cummulative overall current for a standard single wire AC corotron according to the prior art.
Figure 2:
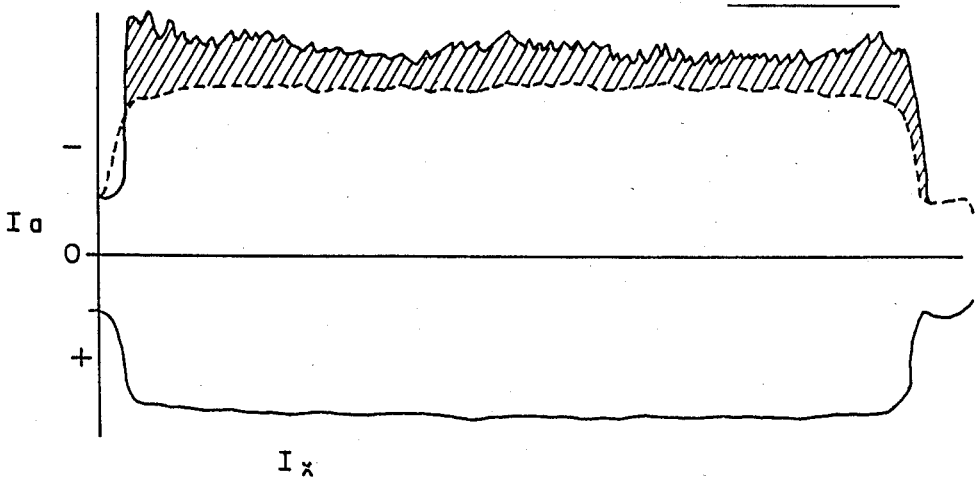
FIG. 2 illustrates the positive and negative current profile along the length of the wire together with the cummulative overall current for the two wire corotron according to the present invention.
Figure 6:
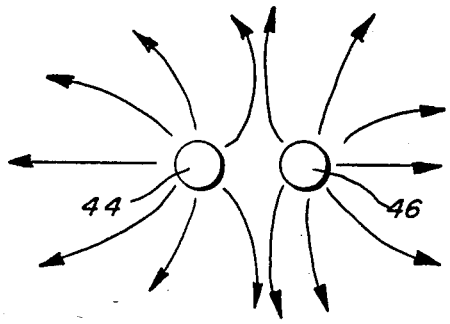
FIG. 6 is aschematic view of the two wire corona generating device illustrating the intersection electrostatic fringe field.

Typically, the wires are spaced less than 200 mils apart without physically touching and are preferably spaced of the order of 45 to 55 mils apart in order for each wire to be within the others fringe field. The intersecting fringe fields generated in such a device are schematically illustrated in FIG. 6. FIG. 2 illustrates the current profile with regard to a double wire, AC corotron according to the present invention. In FIG. 2 it should be noted that the positive phase of the current profile along the corotron wire length is indicated at the bottom which has also been superimposed on the negative phase profile along the corotron wire length in the top of the figure indicating a substantially uniform net negative charge going to the photoreceptor.

The corona generating wires used in this device should be made of the same material and be of the same size and other general characteristics in order to ensure the most uniform charging capabilities. Any suitable metal may be used as a corona generating wire including stainless steel, tungsten, tungsten oxide and gold. Typically the wire is from 1 to 3.5 mils in thickness with 2 mils being preferred as it reaches its threshold very early. In generating the most uniform corona, it is of course desireable that both the wires be of uniform circular cross section. Experience has indicated that tungsten oxide provides the most uniform stable charging capability.

With continued reference to FIGS. 4 and 5, during assembly it has been found convenient to wrap a single strand of wire around wire retaining post 54, placing the two strands of wire in end block adapters and to twist the two strands of wire together over the second wire retaining post 55. At this point a small weight such as about 2 pounds may be attached to the end of the wound two wires to put sufficient tension in the wires to make them straight. Once the tension has been created the fastening plates or clamps 50 may be screwed down into place with screws 52. The tension provided in the wire in this instance should not exceed the level at which the wire may be stretched which typically for 3 mils diameter wire is less than or equal to about 2 pounds. It is also important in fabricating the assembly that this load applied to the wire be applied gradually and carefully and not as an impact load otherwise the wire may be stretched creating non-uniformities in cross section or in fact, fractured.

The potential applied to each wire should be the same to provide uniformity of corona discharge otherwise one will tend to destroy the other. Furthermore, the effect of wire non-uniformity may be decreased by increasing the wire potential to give increased total current output. Any suitable potentials sufficient to raise the wire to the corona generating threshold may be applied. Typically potentials of the order of 3000 to 5000 volts may be employed.

Figure 7:
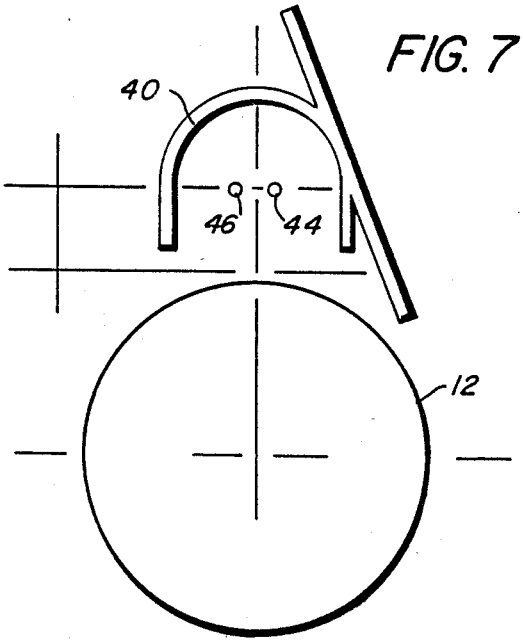
FIG. 7 is a sectional view of the device according to the invention illustrating the two wires in the corona generating device as being in a plane parallel to a tangent of the imaging drum.

In operation, as previously indicated, it is necessary for the individual wires to be parallel to each other to optimize the supressing effect of each wire on the other. Furthermore in order to ensure charge uniformity it is preferrable that the individual wires be parallel to the surface which is being charged. In other words, the two wire corotron should be parallel along the length of the drum, for example, illustrated in FIGS. 3 and 7 to thereby provide equal spacing at all points along the surface being charged from the corona generator. FIG. 7 illustrates the preferred embodiment wherein the two parallel wires of the corona generating device are in a plane parallel to a tangent to the photoconductive drum surface.

By way of specific example, a piece of tungsten oxide wire approximately 40 inches in length has attached to each end a 500 gram weight. The wires center relative to its length is hooked over about a 0.2 inch diameter wire retaining post attached to an end block. The shield is then raised upwardly to suspend the weights to provide wire tension while positioning the wires under the outboard clamp and the screw turned down to secure the assembly. Excess wire is removed by breaking the excess as close as possible to the clamp. The screw securing the outboard end block to the shield is loosened enough to allow the end block to slide for additional wire tension. Using a 1 kilogram weight the tension is increased by pulling on the end block while the shield is positioned vertically. The screw is tightened to prevent slipping and block caps are installed. The assembly is adjusted parallel to a photoconductive surface at a nominal distance of 0.190 inches, and the current input adjusted to 100 micro amps AC by adjusting the wire potential. FIG. 2 illustrates the resulting scans of the positive and negative components.

Thus according to the present invention, a novel corona generating device comprising a plurality of parallel spaced wires is provided such that when energized each wire is placed within the electrostatic fringe field of the adjacent wire. This has particular application to providing uniform corona along the corotron length and thereby providing uniform charging to the photoconductive surface in an electrostatographic copier application.

While the above invention has been described with reference to specific embodiments it will be apparent to those skilled in the art that many alternatives modifications and variations may be made. In particular while the invention has been described with reference to solving problems in standard pre-clean corotrons it can be used in any manner where a substantially uniform corona discharge is desired. For example, it can be used in charging the photoreceptor in transferring the toner image and in detacking a copy sheet from the photoreceptor. Furthermore while the invention has been described principally as an AC corona generating device it will be clear to the artisan that it also may be used in the DC corona generating device for both positive and negative charging. Accordingly, it is intended to embrace such modifications and alternatives as may fall within the spirit and scope of the appended claims.

What is claimed is:

1. A corona generating device comprising a plurality of separate parallel coronode wires supported between insulating end block assemblies, said plurality of parallel coronode wires being spaced less than about 0.2 inches apart relative to the adjacent wire such that when energized each wire is placed within the electrostatic fringe field of the adjacent wire, and means to connect said wires to a coronoa generating potential source.

2. The corona generating device of claim 1, wherein a pair of parallel coronode wires are supported between a pair of insulating end blocks.

3. The corona generating device of claim 2, wherein said pair of parallel coronode wires is formed from a single U-shaped wire with a closed end portion wrapped around an arcuate insulating end post in a first end block assembly.

4. The corona generating device of claim 2, further including a conductive shield extending between and fixedly supporting the end block assembly.

5. The corona generating device of claim 1, wherein said spaced coronode wires are about 0.05 inches apart.

6. The corona generating device of claim 5, wherein said coronode wires are tungsten oxide.

7. The corona generating device of claim 3, including insulating end block adaptors at both ends of the device, said adaptors having a wire positioning slit therein through which both wires pass with each wire being positioned by being urged against opposite sides of the slit.

8. The corona generating device of claim 7, further including an arcuate insulating end post in a second end block assembly around which the ends of the coronode wire may be wrapped, said end posts being larger in diameter than the width of said slit in said end block adaptors whereby said pair of wires by being wrapped around said end posts are urged against opposite sides of the slits in said end block adaptors.

* * * * *